US008132690B2

(12) United States Patent
Hall et al.

(10) Patent No.: US 8,132,690 B2
(45) Date of Patent: Mar. 13, 2012

(54) UNIVERSAL BOX TOP LID

(75) Inventors: Charles E. Hall, Wentzville, MO (US); William A. Hall, O'Fallon, MO (US); Steven C. Hall, Lake St. Louis, MO (US); Michael J. Reddy, Florissant, MO (US)

(73) Assignee: Buddeez, Inc., Wentzville, MO (US)

( * ) Notice: Subject to any disclaimer, the term of this patent is extended or adjusted under 35 U.S.C. 154(b) by 1053 days.

(21) Appl. No.: 10/418,925

(22) Filed: Apr. 18, 2003

(65) Prior Publication Data

US 2004/0206757 A1 Oct. 21, 2004

(51) Int. Cl.
*B65D 43/06* (2006.01)
*B65D 51/18* (2006.01)

(52) U.S. Cl. ..... 220/799; 220/254.3; 220/802; 220/792; 222/480; 222/556; 269/289 R

(58) Field of Classification Search ..... 220/254.3, 220/287, 495.08, 796, 787, 784, 792, 798, 220/799, 800, 801, 802; 215/319; 229/125.01, 229/125.06, 125.09, 125.13, 125.14, 125.17, 229/125.19, 125.26; 269/289 R; 222/480, 222/556

See application file for complete search history.

(56) References Cited

U.S. PATENT DOCUMENTS

| | | | | | |
|---|---|---|---|---|---|
| 539,698 | A | | 5/1895 | Milligan | |
| 571,349 | A | * | 11/1896 | Farquhar | 269/302.1 |
| 2,546,104 | A | * | 3/1951 | MacGregor | 126/377.1 |
| 2,851,713 | A | * | 9/1958 | Tupper | 15/105 |
| 2,990,998 | A | * | 7/1961 | Barclay | 229/125.17 |
| 3,542,235 | A | * | 11/1970 | Hidding | 220/254.2 |
| 3,655,089 | A | | 4/1972 | Tower | |
| 4,177,932 | A | * | 12/1979 | Cleevely | 220/787 |
| 4,183,457 | A | * | 1/1980 | Loughley et al. | 229/5.5 |
| 4,192,434 | A | * | 3/1980 | Conroy | 229/125.13 |
| 4,491,252 | A | * | 1/1985 | Schmidt et al. | 222/531 |
| 4,702,389 | A | * | 10/1987 | Bozinovich et al. | 220/784 |
| 4,759,478 | A | * | 7/1988 | Richardson et al. | 222/556 |
| 4,840,361 | A | * | 6/1989 | Richter | 269/289 R |
| 5,027,999 | A | | 7/1991 | Kücherer | |
| 5,050,763 | A | * | 9/1991 | Christensson | 220/810 |
| 5,062,552 | A | * | 11/1991 | Heubel | 222/570 |
| 5,121,909 | A | * | 6/1992 | Stickel, III | 269/289 R |
| 5,211,305 | A | * | 5/1993 | Horton | 229/117.27 |
| 5,467,888 | A | * | 11/1995 | Brandstrom et al. | 220/319 |
| 5,884,800 | A | | 3/1999 | Hall | |
| 6,152,318 | A | * | 11/2000 | Walker | 220/379 |
| 6,386,531 | B1 | * | 5/2002 | Prosser | 269/15 |
| 2002/0070218 | A1 | * | 6/2002 | Mozes | 220/254.3 |

OTHER PUBLICATIONS

Annotated figure of Tupper reference.*

* cited by examiner

*Primary Examiner* — Anthony Stashick
*Assistant Examiner* — James N Smalley
(74) *Attorney, Agent, or Firm* — Joseph M. Rolnicki; Evans & Dixon, LLC

(57) ABSTRACT

A universal box top lid is adapted to be attached to the opened top of a variety of different sizes of food packaging boxes. The lid is designed to fit over the opened box top with an opened bag containing the food product inside the box being held open by an apron formed on an inner wall of the lid. The lid is provided with a cap closure that can be opened when it is desired to dispense the food product contained in the packaging box and bag, and can be closed to preserve the food product.

7 Claims, 6 Drawing Sheets

UNIVERSAL BOX TOP LID

BACKGROUND OF THE INVENTION

1. Field of the Invention

The present invention pertains to a lid that is designed to be attached to the opened tops of a variety of different size food-packaging boxes. The lid is designed to fit over the opened box top with or without an opened hermetic bag containing the food product inside the box being held open by the lid. The lid is provided with a cap closure that can be opened when it is desired to dispense the food product contained in the packaging box and bag and can be closed to preserve the food product.

2. Description of the Related Art

Food products such as breakfast cereals, crackers and snack foods have long been packaged in hermetically sealed bags that are contained in cardboard boxes. Perhaps the most familiar food product contained in a sealed bag in a cardboard box is breakfast cereal.

Breakfast cereals are offered to consumers in a variety of different package sizes. In opening a new package of breakfast cereal the box is typically opened by pulling apart and folding back four flaps at the top of the box. The hermetically sealed bag in the box is then opened at the top of the bag. After the desired amount of cereal is dispensed from the package the bag is usually folded over or rolled up to reseal the bag. The flaps of the box top are folded over and a tab on one of the larger box flaps is inserted into a slot or under an edge indentation in the opposite larger box flap to close the box. Each time it is desired to dispense a certain amount of the breakfast cereal from the package it is necessary to pull apart and fold back the four box flaps, unroll or unfold the top of the bag in the box before dispensing the desired amount of cereal, fold or roll up the top of the bag after the desired amount of cereal has been dispensed and then fold over the box flaps engaging the flap tab and flap slot or flap tab and flap edge indentation to close the box.

The above steps taken to open and close the packaging of breakfast cereal can at times become tedious. What would overcome this problem is a lid that could be attached to the opened top of the breakfast cereal box where the lid has a cap that is easily opened when it is desired to dispense an amount of cereal from the box and closed after the amount of cereal has been dispensed. However, as stated above, breakfast cereal packaging comes in a variety of different sizes. The boxes employed in packaging breakfast cereals are typically rectangular in shape. The box tops of the different size boxes are defined by pairs of opposite side panels of the boxes that have short lengths and pairs of opposite front and rear panels of the boxes that have longer lengths than the side panels. The dimensions of the opposite front and rear panels of the different sizes of breakfast cereal boxes differ substantially. The dimensions of the opposite side panels of the different sizes of breakfast cereal boxes are not significantly different when compared to the differences in lengths of the front and rear panels. Thus, to provide a removable lid that could be removably attached to the open top of a breakfast cereal box to facilitate dispensing cereal from the box through the lid and then closing the lid after the desired amount of cereal was dispensed would require a separate lid dimensioned to fit the opened tops of the various different sizes of breakfast cereal boxes.

SUMMARY OF THE INVENTION

The disadvantages discussed above are overcome by the universal box top lid of the present invention that is designed to be removably attached to a variety of different size boxes that are presently employed in packaging breakfast cereal.

In preparation for use of the universal box top lid of the invention, the packaging of the breakfast cereal is first opened by opening the box top and folding over the closure flaps of the box top. The hermetic bag containing the breakfast cereal inside the box is then opened at the top of the bag. The packaging of the breakfast cereal is then prepared for use with the universal box top lid of the invention.

As stated earlier, the various different sizes of breakfast cereal boxes have opposite short side panels and longer front and rear panels that are longer than the side panels. The length dimensions of the opposite front and rear panels of the various different sizes of breakfast cereal boxes differ substantially. The length dimensions of the side panels of the various different sizes of cereal boxes are not substantially different when compared with the differences in the length dimensions of the front and rear panels.

The universal box top lid is designed to fit over the open box top of the many different sizes of breakfast cereal packaging boxes. The lid has opposite top and bottom surfaces and is dimensioned to cover over the box top opening of the larger breakfast cereal boxes. A continuous channel is formed in the lid bottom surface adjacent the periphery of the bottom surface. The channel has a rectangular configuration that is defined by an inner wall of the channel and an outer wall of the channel. The channel inner wall has a rectangular configuration dimensioned to fit inside of the open top of smaller boxes of the various different size boxes that package breakfast cereal. The channel outer wall has a rectangular configuration dimensioned to fit outside of the open top of larger boxes of the various different size boxes that package breakfast cereal.

The rectangular configuration of the channel is defined by a first short section of the channel that is dimensioned to receive a first short side panel of the box, a second short section of the channel that is dimensioned to receive the second short side panel of the box and third and fourth sections of the channel that are dimensioned to receive the respective front panel and rear panel of the box.

The widths of the first channel section, third channel section and fourth channel section between the inner wall and outer wall of the channel that define these sections are dimensioned to receive the top edge of the open box top in a snug fit between the inner wall and outer wall of the channel. The width of the second channel section is dimensioned much larger than the widths of the first channel section, the third channel section and the fourth channel section. The width dimension of the second channel section is designed to adapt the box top lid to fit over the variety of different lengths of cereal boxes presently available. The top edges of the box tops of smaller breakfast cereal packaging boxes and the top edges of the box tops of larger breakfast cereal packaging boxes can fit into the channel of the universal box top lid due to the enlarged width dimension of the second section of the channel.

The widths of the first, third and fourth channel sections are designed to grip the top edge of the box along the front and rear panels and one side panel. To enhance the connection of the lid with the box top, a plurality of opposed protrusions or elongate walls are provided in the second section of the channel. The opposed pairs of protrusions are spatially arranged across the width of the second section of the channel so that different opposed pairs of the plurality of protrusions will receive the top edge of the second side panel of the different size boxes to which the lid is attached. The engagement of the top edge of the open cereal box between the inner and outer walls of the channel in the first section, third section and fourth section of the channel and the engagement of the top edge of the open cereal box between a pair of the opposed pairs of protrusions in the second section of the channel enables the universal box top lid of the invention to be attached to the opened tops of breakfast cereal packaging boxes of various different sizes.

The universal box top lid of the invention is also provided with a cap closure that is mounted to the lid for movement of the cap between opened and closed positions over an opening through the lid. In the opened position the cap is displaced from the lid opening to enable easy dispensing of the breakfast cereal contained in the packaging through the lid opening. When moved to its closed position the cap seals over the lid opening reestablishing the sealing of the breakfast cereal packaging provided by the lid.

Thus, the universal box top lid of the present invention provides a lid that can be removably attached to the opened box top of breakfast cereal packaging boxes of various different sizes where the lid can be easily opened to dispense a desired amount of breakfast cereal from the box and then can be easily closed to preserve the breakfast cereal in the box.

BRIEF DESCRIPTION OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

Figure 1:
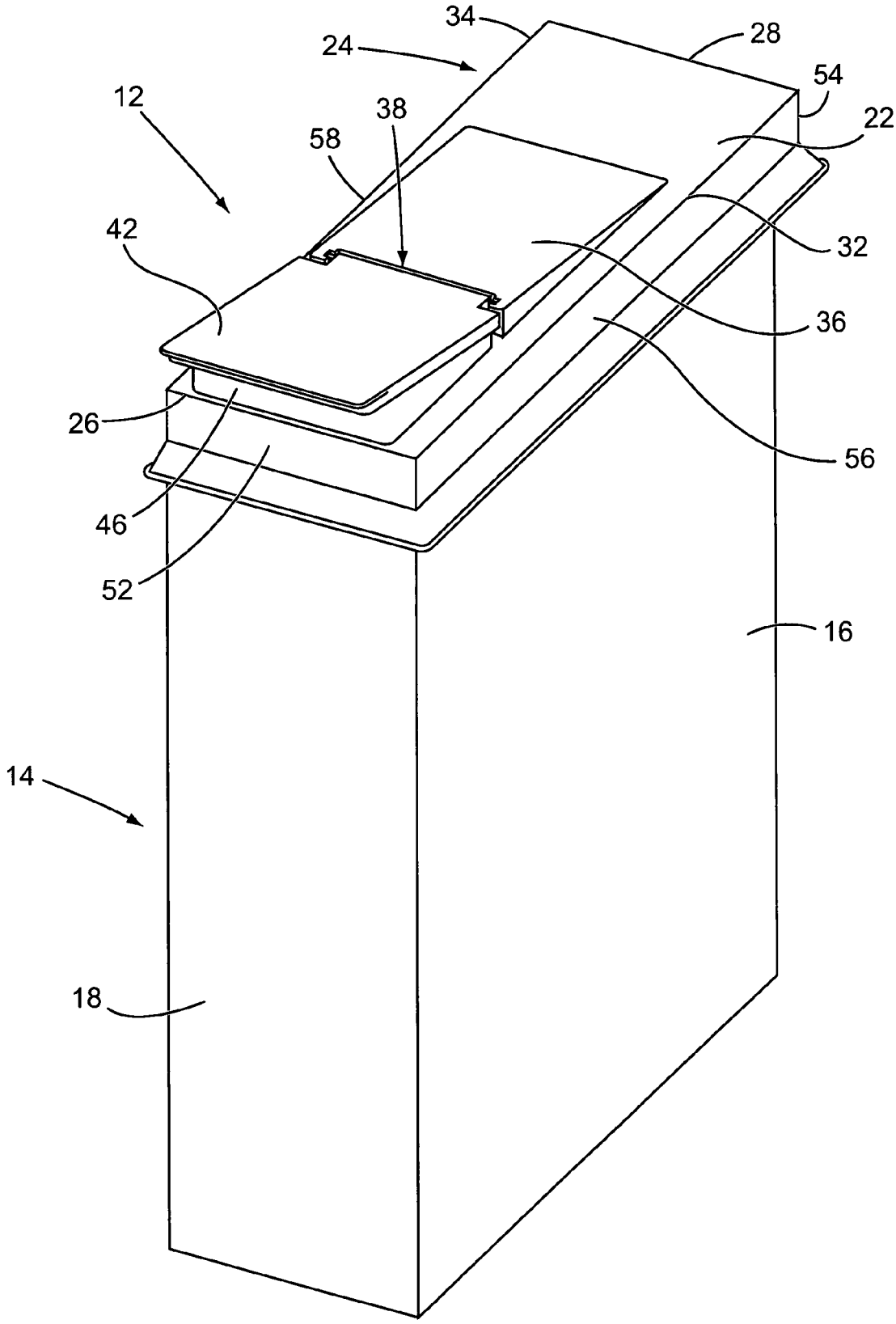
FIG. 1 is a perspective view of a conventional breakfast cereal packaging box to which the universal box top lid of the present invention has been attached.

FIG. 1 is a perspective view of the universal box top lid 12 of the present invention removably attached to the opened top of a breakfast cereal packaging box 14. In the preferred embodiment the lid 12 is constructed of a resilient plastic material that facilitates its attachment to the opened top of breakfast cereal boxes of various different sizes. The box 14 shown in FIG. 1 is only one example of the various different sizes of boxes that are presently employed in packaging breakfast cereals.

The box is basically comprised of closed bottom panels (not shown), a front panel 16 that typically displays the trademark of the breakfast cereal contained in the box, an opposite back panel (not shown), a first sidewall panel 18 and a second, opposite sidewall panel (not shown). As stated earlier, in the various different sizes of breakfast cereal boxes available, the length dimensions of the front panel 16 and back panel (not shown) vary significantly. The differences in the length dimensions of the sidewall panels 18 of the different sizes of cereal boxes is not as substantial as the differences in the dimensions of the front and rear panels. The universal box top lid 12 is shown in FIG. 1 attached to the opened top of the box 14 where the four flaps typically provided on the box top have been folded over, exposing top edges of the front and rear panels and the first and second sidewall panels.

Much of the construction of the lid 12 is similar to that of the lid of the U.S. patent of Hall U.S. Pat. No. 5, 884, 800, incorporated herein by reference. Because several of the structural features of the lid 12 of the invention are also described in the above referenced patent, those features will not be described in detail.

Figure 3:
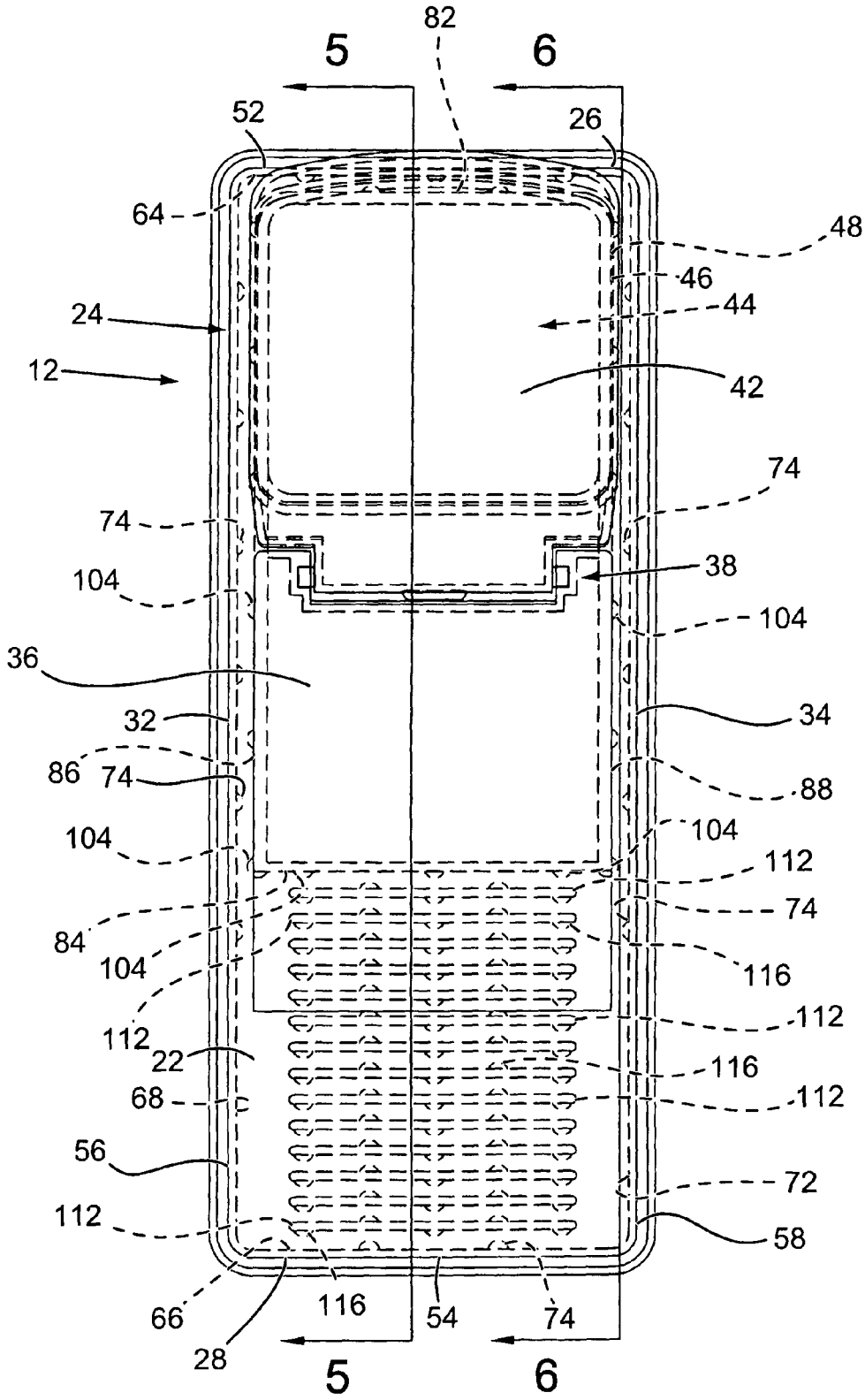
FIG. 3 is a plan view of the top of the box top lid.

FIG. 3 is a plan view of the lid top surface 22. The top surface 22 has a rectangular configuration defined by a peripheral edge 24 of the top surface. The top surface has a length between a first portion 26 and an opposite second portion 28 of the surface peripheral edge, and the top surface has a width between a third portion 32 and an opposite fourth portion 34 of the surface peripheral edge.

Figure 2:
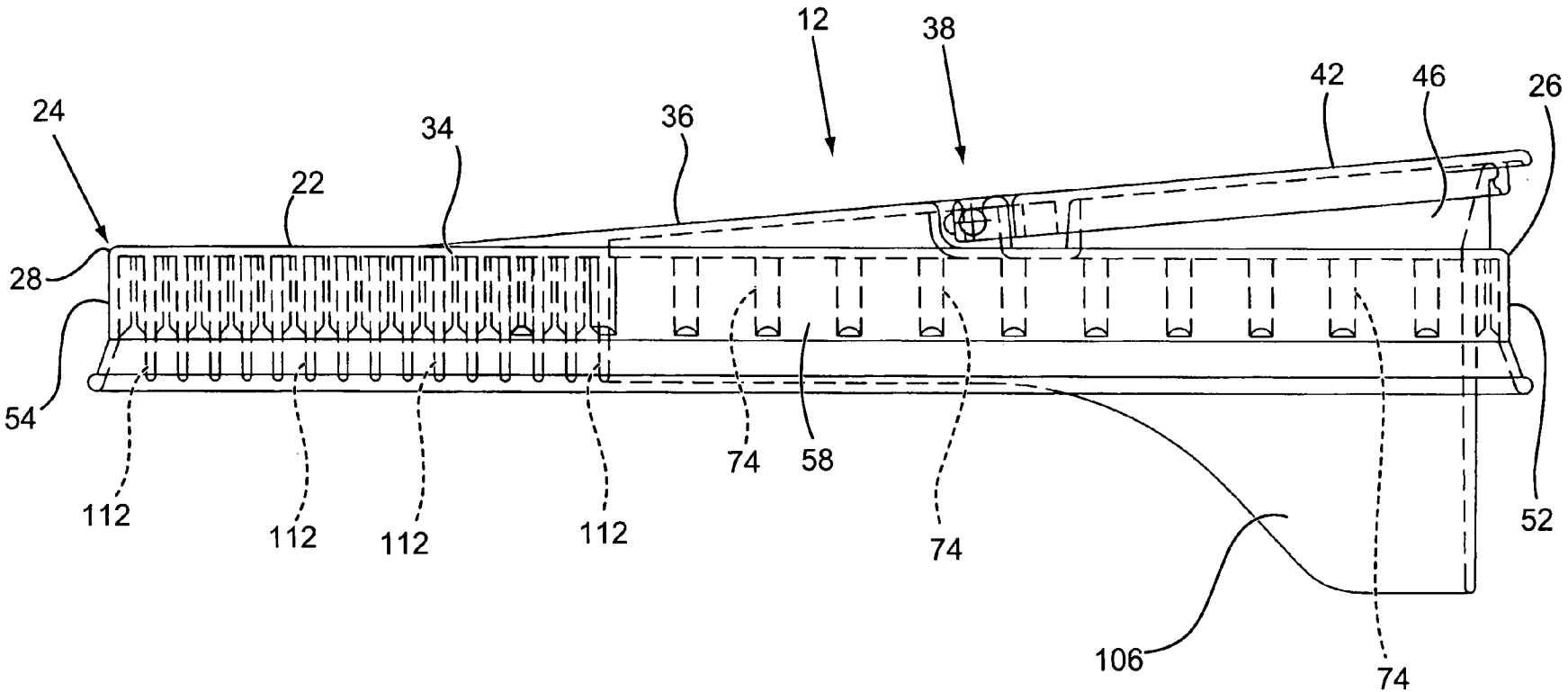
FIG. 2 is a side elevation view of the box top lid removed from the breakfast cereal packaging box.

As best seen in FIG. 2, as the top surface 22 extends from the second portion 28 of the surface peripheral edge toward the first portion 26 of the surface peripheral edge, a section 36 of the top surface inclines upwardly. The top surface inclined section 36 accommodates a pivot connection 38 to a cap 42 of the lid.

The cap 42 has a rectangular configuration that covers over the rectangular configuration of an opening 44 through the lid 12. The opening 44 is bounded by a rectangular opening wall 46. The underside of the cap 42 has a rectangular rim 48. The rim 48 is dimensioned to fit around the opening wall 46 in a snug sealing engagement with the cap moved to its closed position shown in drawing FIGS. 1-3. The pivot connection 38 enables the cap 42 to be pivoted about the pivot connection and displaced from the cap opening 44 to open the lid for dispensing contents from the box 14 to which the lid is attached.

An outer sidewall of the lid projects downwardly from the lid top surface peripheral edge 24. The lid outer sidewall is comprised of opposite first 52 and second 54 sections that extend downwardly from the first and second portions 26, 28, respectively, of the top surface peripheral edge and opposite third 56 and fourth 58 sections that extend downwardly from the opposite third and fourth portions 32, 34, respectively, of the top surface peripheral edge. Together the four outer sidewall sections 52, 54, 56, 58 have a rectangular configuration that is dimensioned sufficiently large to engage over the open box top of the most popular larger breakfast cereal packaging boxes presently available. As seen in FIGS. 1-3, the bottom edges of the lid outer sidewall sections 52, 54, 56, 58 angle outwardly. This configuration of the sidewall bottom edges facilitates the attachment of the lid 12 over the opened top of a breakfast cereal box.

Figure 4:
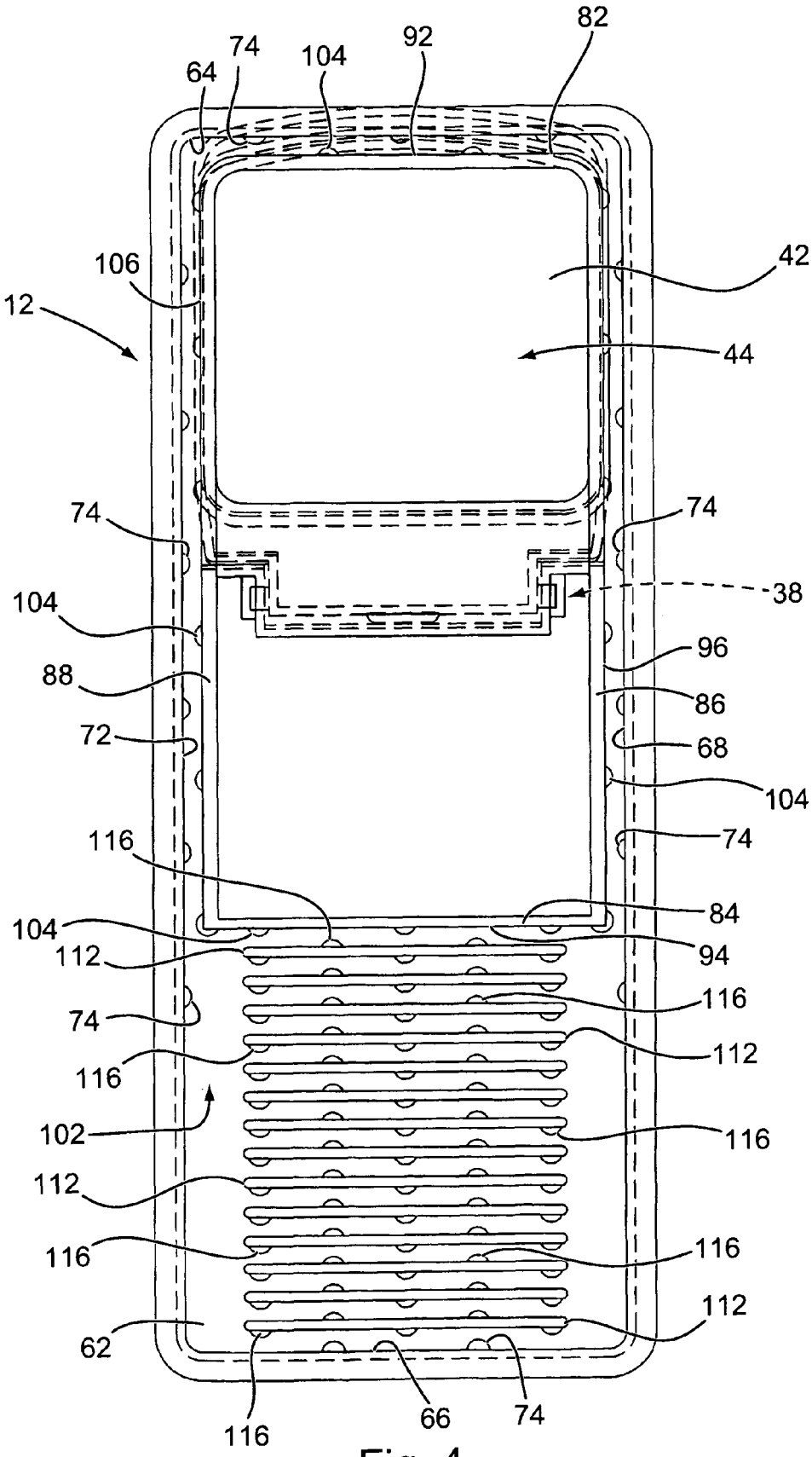
FIG. 4 is a plan view of the bottom of the box top lid.

FIG. 4 is a plan view of the lid bottom surface 62. The novel features of the lid 12 that are not suggested in the earlier referenced U.S. patent are incorporated into the construction of the lid bottom surface 62. The bottom surface 62 also has a rectangular configuration defined by the respective interior surfaces 64, 66, 68, 72 of the four outer sidewall sections 52, 54, 56, 58. A plurality of protrusions 74 are spatially arranged around the sidewall section interior surfaces 64, 66, 68, 72 and project inwardly from these surfaces. As seen in FIG. 2, the protrusions 74 extend downwardly across the sidewall section interior surfaces 64, 66, 68, 72 to the outwardly angled bottom edges of the sidewall sections. FIG. 4 also shows the rectangular opening 44 that passes through the lid 12.

A rectangular inner wall depends downwardly from the lid bottom surface 62. The inner wall is defined by a first inner wall section 82 and an opposite second inner wall section 84, a third inner wall section 86 and an opposite fourth inner wall section 88. Each of the inner wall sections 82, 84, 86, 88 has a respective exterior surface 92, 94, 96, 98. The inner wall section exterior surfaces 92, 94, 96, 98 oppose the respective interior surfaces 64, 66, 68, 72 of the four outer sidewall sections 52, 54, 56, 58. The opposing surfaces define a rectangular channel 102 between the inner wall and outer sidewall of the lid. Pluralities of protrusions 104 project outwardly from the inner wall exterior surfaces 92, 94, 96, 98 and into the channel 102.

Figure 5:
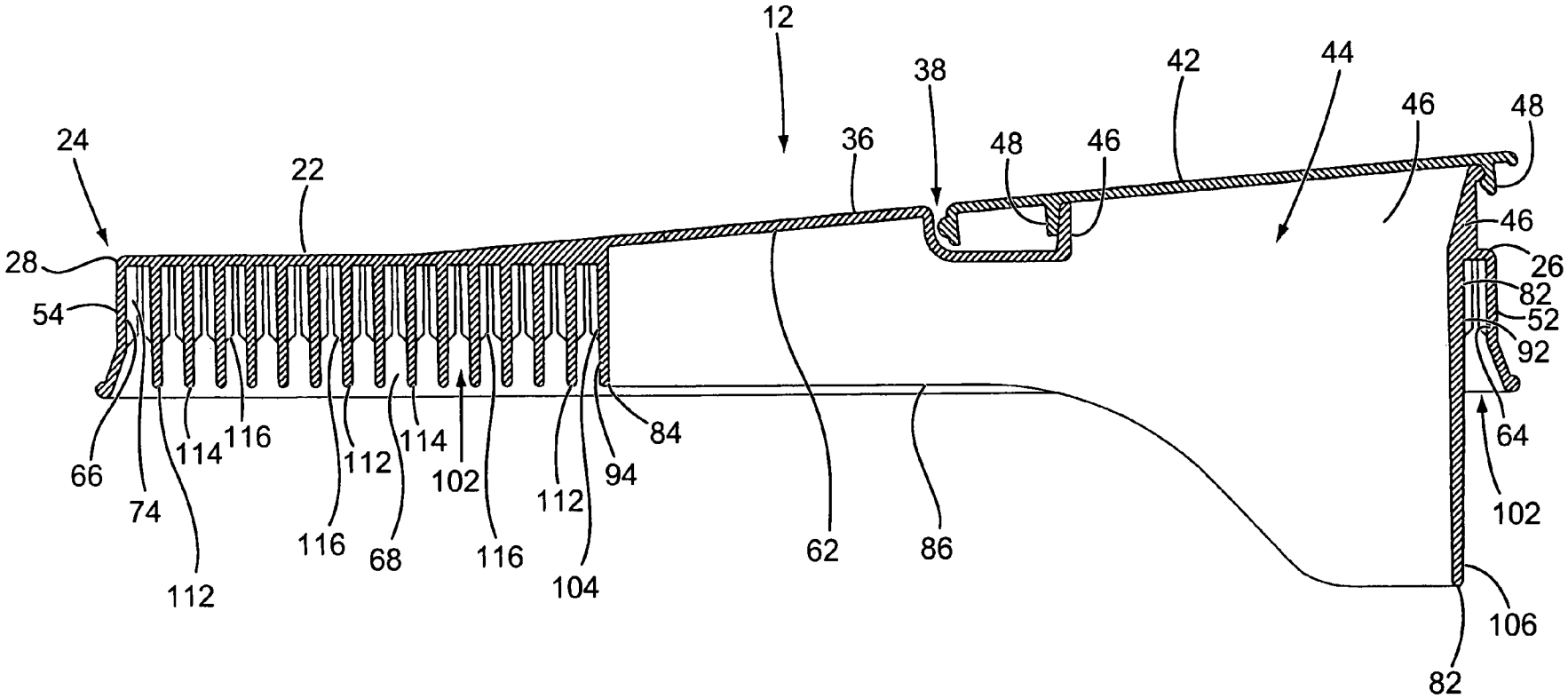
FIG. 5 is a side cross section view of the lid along the line 5-5 of FIG. 3.
Figure 6:
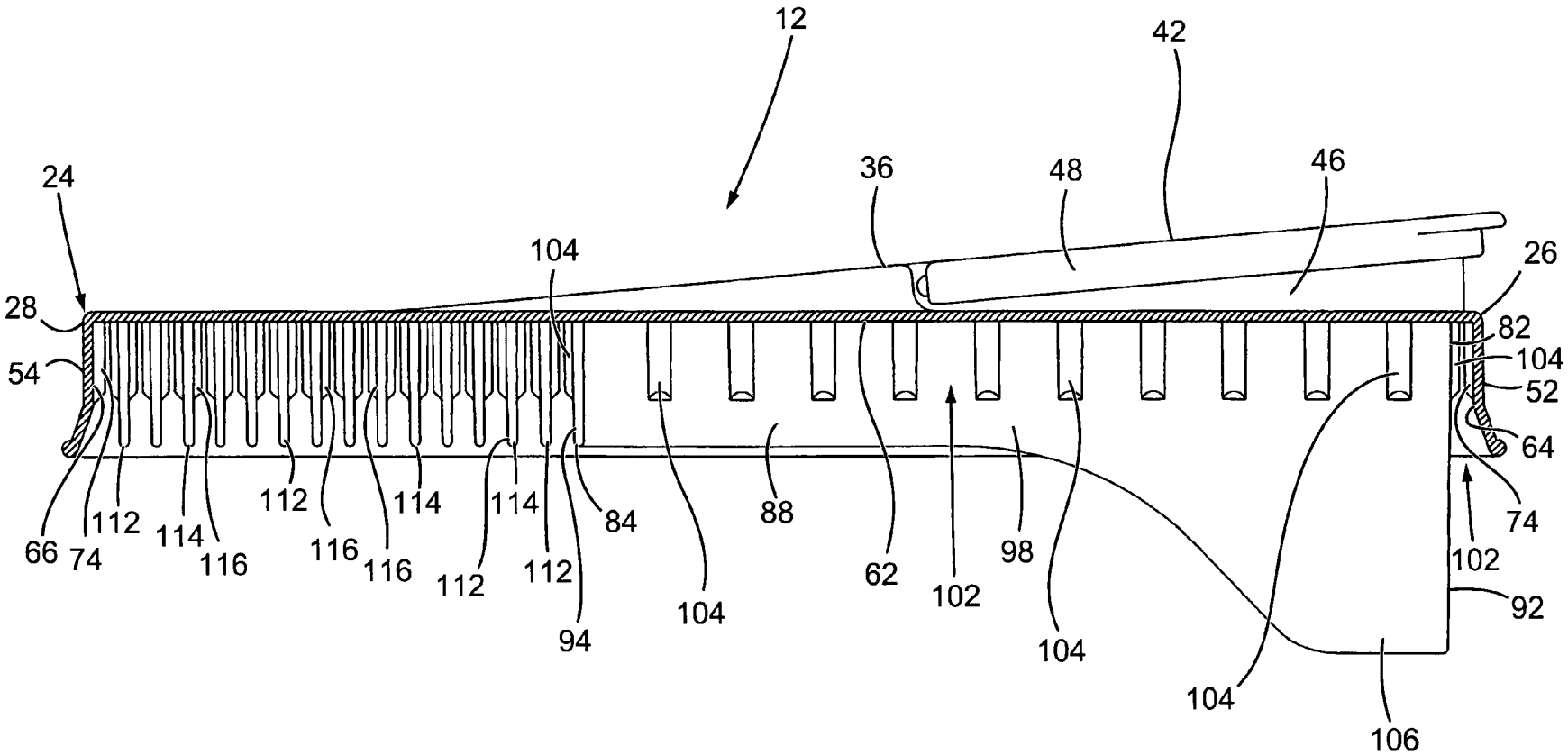
FIG. 6 is a side cross section view of the lid along the line 6-6 of FIG. 3.

As best seen in FIGS. 2, 5 and 6, as the third inner wall and fourth inner wall sections 86, 88 extend toward the first inner wall section 82 they taper downwardly creating an apron 106 in this portion of the inner wall. The apron 106 engages inside the opened bag of the breakfast cereal packaging to hold the bag open when the lid 12 is attached to the top of the packaging box 14 as shown in FIG. 1. The apron 106 insures that the cereal dispensed from the breakfast cereal packaging passes through the lid opening 44 when the packaging is tilted toward the lid opening to dispense the contents of the packaging.

The width of the channel 102 between the interior surface 64 of the first outer sidewall section 52 and the exterior surface 92 of the first inner wall section 82 is dimensioned to receive the top edge of a first sidewall panel 18 of the breakfast cereal packaging box 14 in a snug fit. In one embodiment of the invention the width dimension of this first section of the channel alone could be relied on to hold the lid to the first sidewall panel 18 of the box. However, in the preferred embodiment the plurality of protrusions 74 on the interior surface 64 of the first outer sidewall section 52 and the plurality of protrusions 104 on the exterior surface 92 of the first inner wall section 82 insure that the top edge of the box sidewall panel 18 is securely held in the channel portion when the lid 12 is placed on top of the box 14 as shown in FIG. 1.

The width of the third channel section defined between the interior surface 68 of the third outer sidewall section 56 and the exterior surface 96 of the third inner wall section 86 is dimensioned to receive the top edge of the front panel of the box 14 in a snug fit when the lid 12 is attached to the top of the box 14 as shown in FIG. 1. As stated earlier, the width dimension of this section of the channel alone could be relied on to hold the lid to the front panel of the box 14. However, in the preferred embodiment the pluralities of protrusions 74, 104 on the respective interior surface 68 of the third outer sidewall 56 and the exterior surface 96 of the third inner wall section 86 insure the top edge of the box front panel 16 is securely held in the third section of the channel 102.

The width of the fourth channel section defined between the interior surface 72 of the fourth outer sidewall section 58 and the exterior surface 98 of the fourth inner wall section 88 receives a top edge of the rear panel 16 of the packaging box 14 in a snug fit when the lid 12 is positioned on top of the box 14 as shown in FIG. 1. Again, the width of this section of the channel alone could be relied on to hold the lid 12 to the top edge of the box rear panel. However, in the preferred embodiment the pluralities of protrusions 74, 104 on the respective interior surface 72 of the fourth outer sidewall section 58 and the exterior surface 98 of the fourth inner wall section 88 insure that the top edge of the box rear panel is securely held in this portion of the channel 102.

As best seen in FIG. 4, in the preferred embodiment of the invention the plurality of protrusions 74, 104 on the opposite sides of the channel 102 are not directly opposite each other, but are arranged in a staggered relationship. Depending on the extent to which the plurality of protrusions 74, 104 project into the width of the channel 102, the staggered relationship of the protrusions 74, 104 deforms the top edge of the open breakfast cereal box 14 in a narrow wave pattern that further enhances the ability of the protrusions 74, 104 to hold the lid 12 to the top of the box 14. Thus, employing the protrusions 74, 104 in the width of the channel 102, it can be seen that the dimension of the channel width is not critical in securing the lid 12 to the top of the box 14. Channels of larger widths than that shown in FIG. 4 would merely employ protrusions 74, 104 that extend to a greater extent into the channel widths.

As best seen in FIG. 4, the width dimension between the interior surface 66 of the second outer sidewall section 54 and the exterior surface 94 of the second inner wall section 84 is substantially larger than the width dimensions of the other portions of the channel 102. This substantially larger width dimension of this portion of the channel is designed to receive the second sidewall panel of the box 14 for a variety of different size breakfast cereal boxes when the lid is attached to the top of the box as shown in FIG. 1.

To securely hold the second sidewall panel of the breakfast cereal packaging box 14 in the second portion of the channel 102 between the second outer sidewall section 54 and the second inner wall section 84, a plurality of additional protrusions are provided on the lid bottom surface 62 in this portion of the channel. The additional protrusions are formed as elongate panels or walls 112 that extend outwardly from the lid bottom surface 62. Distal edges 114 of the walls are formed as convex curves to facilitate their insertion into the open top of the box 14. The plurality of panels or walls 112 are arranged parallel to each other and parallel to the interior surface 66 of the second outer sidewall section 54 and the exterior surface 94 of the second inner wall section 84. Furthermore, the spacing between adjacent pairs of the walls 112 is the same as the width dimension between the interior surfaces 64, 68, 72 of the first, third and fourth outer sidewall sections 52, 56, 58 and the respective exterior surfaces 92, 96, 98 of the first, third and fourth inner wall sections 82, 86, 88. Still further, the width dimension between the interior surface 66 of the second sidewall section 54 and the closest wall 112 is the same as the width dimension between adjacent pairs of walls. The width dimension between the exterior surface 94 of the second inner wall section 84 and the closest wall 112 is the same as the width dimension between adjacent pairs of walls.

In addition, pluralities of protrusions 116 project outwardly from the opposite sides of each of the walls 112. Opposing protrusions 116 on opposite walls are arranged in the staggered arrangement of the protrusions 74, 104 in the other sections of the channel 102. The width dimensions between the walls 112 and the protrusions 116 provided on the walls insure that the top edge of the second sidewall panel of the breakfast cereal box 14 is securely held to the lid 12 for various different sizes of breakfast cereal packaging boxes 14 available.

In a variant embodiment of the invention the walls 112 in the second portion of the channel 102 could be eliminated and the plurality of protrusions 116 could be formed as rows of posts in the channel second portion.

In attaching the universal box top lid 12 to the top of the breakfast cereal packaging box 14 or to the top of any other type of food packaging box, the box 14 is first prepared by opening the top flaps (not shown) of the box. Preferably, the top flaps of the box are then folded over exposing a top edge of the box top opening. Alternatively, the flaps could be removed. If the box contains a hermetically sealed bag containing the food product, the bag is then opened adjacent the top of the box. A portion of the bag can then be folded over the top edge of the box adjacent the box first side wall panel 18 where the lid apron 106 will be inserted, or the bag could just be left open inside the box top.

The lid 12 is then positioned with the apron 106 extending downwardly into the open bag. The first section of the channel 102 between the first sidewall interior surface 64 and the exterior surface 92 of the inner wall first section 82 is positioned on top of a first sidewall panel 18 that will function as the side of the box from which the box contents will be dispensed. The lid 12 is then moved downwardly in a pivoting movement causing the top edge of the sidewall panel 18 to be inserted into the first section of the channel between the first sidewall section interior surface 64 and the first inner wall section exterior surface 92. As the pivoting movement continues the top edge of the box front panel 16 and the top edge of the box rear panel are gradually inserted into the respective third and fourth sections of the channel between the third sidewall section interior surface 68 and the third inner wall section exterior surface 96 and between the fourth side wall section interior surface 72 and the fourth inner wall section exterior surface 98.

As the lid 12 moves downwardly on the top edge of the box 14, the second side wall panel will enter into the portion of the channel 102 between the second side wall section interior surface 66 and the second inner wall section exterior surface 94. Depending on the size of the box and the box top opening, the second side wall panel will enter into the spacing between the second side wall section interior surface 66 and its opposing wall 112, between the second inner wall section exterior surface 94 and its opposing wall 112, or between a pair of opposing walls 112. The curvature at the wall distal edges 114 facilitates the insertion of the wall into the open box top at the second side wall panel. Depending on the length dimensions of the box side wall panels 18, it may be necessary to fold the top edge of the box where the front 16 and rear panels intersect the two side wall panels 18 to fit the lid 12 on the open box top of smaller boxes.

The cap 42 of the lid 12 can now be opened and closed as desired to dispense the contents of the box 14 and reseal the box.

Thus, the universal box top lid 12 of the invention can be attached to the opened tops of a variety of different sizes of food packaging boxes to provide the convenience of dispensing the contents of the boxes through the opened cap 42 of the lid and the convenience of closing the box by merely closing the cap 42 of the lid.

While the present invention has been described by reference to a specific embodiment, it should be understood that modifications and variations of the invention may be constructed without departing from the scope of the invention defined in the following claims.

What is claimed is:

1. A lid that is removeably attachable to a plurality of different containers of different sizes to cover over top openings of the plurality of containers, the lid comprising:

a top surface and an opposite bottom surface, a peripheral edge extending around the lid and separating the top surface from the bottom surface;

a channel on the lid bottom surface, the channel extending around the lid bottom surface adjacent the lid peripheral edge, the channel having a rectangular configuration with opposite first and second channel sections and opposite third and fourth channel sections, the channel first section having a first width dimension, the channel second section having a second width dimension, the channel third section having a third width dimension, the channel fourth section having a fourth width dimension; the first width dimension, the second width dimension, the third width dimension and the fourth width dimension are between opposed parallel walls of the channel;

the second width dimension being larger than the first width dimension, the third width dimension and the fourth width dimension; and, an opening through the lid adjacent the channel first section and spaced from the channel second section.

2. The lid of claim 1, further comprising:

the first width dimension, the third width dimension and the fourth width dimension being equal.

3. A lid that is removeably attachable to a plurality of different containers of different sizes to cover over top openings of the plurality of containers, the lid comprising:

a top surface and an opposite bottom surface, a peripheral edge extending around the lid and separating the top surface from the bottom surface;

a channel on the lid bottom surface, the channel extending around the lid bottom surface adjacent the lid peripheral edge, the channel having a rectangular configuration with opposite first and second channel sections and opposite third and fourth channel sections, the channel first section having a first width dimension, the channel second section having a second width dimension, the channel third section having a third width dimension, the channel fourth section having a fourth width dimension; the first width dimension, the second width dimension, the third width dimension and the fourth width dimension are between opposed parallel walls of the channel;

the second width dimension being larger than the first width dimension, the third width dimension and the fourth width dimension; and, the opposed walls of the channel have pluralities of protrusions that project from the walls into the channel.

4. The lid of claim 3, further comprising:

the pluralities of protrusions on the opposed walls of the channel are positioned in a staggered arrangement.

5. A lid that is removeably attachable to a plurality of different containers of different sizes to cover over top openings of the plurality of containers, the lid comprising:

a top surface and an opposite bottom surface, a peripheral edge extending around the lid and separating the top surface from the bottom surface; and a channel on the lid bottom surface, the channel extending around the lid bottom surface adjacent the lid peripheral edge, the channel having a rectangular configuration with opposite first and second channel sections and opposite third and fourth channel sections, the channel first section having a first width dimension, the channel second section having a second width dimension, the channel third section having a third width dimension, the channel fourth section having a fourth width dimension;

the second width dimension being larger than the first width dimension, the third width dimension and the fourth width dimension; and, a plurality of walls arranged side by side in the second channel section.

6. A lid that is removeably attachable to a plurality of different containers of different sizes to cover over top openings of the plurality of containers, the lid comprising:

a top surface and an opposite bottom surface, a peripheral edge extending around the lid and separating the top surface from the bottom surface; and a channel on the lid bottom surface, the channel extending around the lid bottom surface adjacent the lid peripheral edge, the channel having a rectangular configuration with opposite first and second channel sections and opposite third and fourth channel sections, the channel first section having a first width dimension, the channel second section having a second width dimension, the channel third section having a third width dimension, the channel fourth section having a fourth width dimension;

the second width dimension being larger than the first width dimension, the third width dimension and the fourth width dimension; and a plurality of protrusions in the second channel section.

7. The lid of claim 6, further comprising:

the plurality of protrusions being arranged in a plurality of rows.

* * * * *